US011685568B2

(12) United States Patent
Wegner et al.

(10) Patent No.: US 11,685,568 B2
(45) Date of Patent: Jun. 27, 2023

(54) ADJUSTABLE PACKAGING MACHINE

(71) Applicant: Infinity Machine & Engineering Corp., De Pere, WI (US)

(72) Inventors: Thomas Wegner, De Pere, WI (US); Jeffrey Cogswell, Neenah, WI (US); Brian Borowski, Suamico, WI (US)

(73) Assignee: Infinity Machine & Engineering Corp., De Pere, WI (US)

( * ) Notice: Subject to any disclaimer, the term of this patent is extended or adjusted under 35 U.S.C. 154(b) by 0 days.

(21) Appl. No.: 17/208,678

(22) Filed: Mar. 22, 2021

(65) Prior Publication Data

US 2022/0297862 A1 Sep. 22, 2022

(51) Int. Cl.
*B65B 59/00* (2006.01)
*B65B 41/12* (2006.01)
(Continued)

(52) U.S. Cl.
CPC ..... *B65B 59/003* (2019.05); *B65B 11/18* (2013.01); *B65B 25/146* (2013.01); *B65B 41/12* (2013.01);
(Continued)

(58) Field of Classification Search
CPC ... B65B 25/146; B65B 25/148; B65B 59/003; B65B 59/005; B65B 11/08; B65B 11/10–16; B65B 11/18; B65B 11/54; B65B 45/00; B65B 41/12; B65B 41/16; B65B 61/12; B65B 61/02; B26F 3/002; B65H 35/10; B65H 2513/10; B65H 2513/104; B65H 2301/51514;
(Continued)

(56) References Cited

U.S. PATENT DOCUMENTS 3,471,994 A 10/1969 Cranston et al.
3,494,095 A 2/1970 Valvano
(Continued)

FOREIGN PATENT DOCUMENTS

WO WO-2011015245 A1 * 2/2011 ..... B65B 11/08

OTHER PUBLICATIONS

European search report dated Mar. 31, 2022 issued in correspoding Application No. 21201913.7.

*Primary Examiner* — Joshua G Kotis
(74) *Attorney, Agent, or Firm* — Andrus Intellectual Property Law, LLP

(57) ABSTRACT

An unwind station for a packaging machine may be configured to form wrappers having different sizes from a web of packaging material and supply the wrapper to a wrapping station. The unwind station may include a base configured to support the web of packaging material and a carriage configured to selectively slide in a longitudinal direction on the base. A rotating blade can be configured to periodically score the web to form a break line extending between lateral sides of the web. A first conveyor arm and a second conveyor arm may project longitudinally outward from the carriage. The first conveyor arm and the second conveyor arm can each include a low-speed conveyor configured to transport the web to a high-speed conveyor. The high-speed conveyor is configured to separate the wrapper from the web as the break line passes a shear point between the low-speed conveyors and the high-speed conveyors.

17 Claims, 16 Drawing Sheets

(51) Int. Cl.

| | |
|---|---|
| ***B65B 45/00*** | (2006.01) |
| ***B65B 61/02*** | (2006.01) |
| ***B65B 61/12*** | (2006.01) |
| ***B65B 11/18*** | (2006.01) |
| ***B65B 25/14*** | (2006.01) |
| *B65B 11/08* | (2006.01) |
| *B65B 41/16* | (2006.01) |

(52) U.S. Cl.
CPC ..... *B65B 45/00* (2013.01); *B65B 59/005* (2013.01); *B65B 61/02* (2013.01); *B65B 61/12* (2013.01); *B65B 11/08* (2013.01); *B65B 41/16* (2013.01); *B65B 2210/04* (2013.01)

(58) Field of Classification Search
CPC ..... B65G 21/12; B65G 21/14; B65G 15/26; B65G 41/003; B65G 41/007; B65G 41/008; B65G 41/02
See application file for complete search history.

(56) References Cited

U.S. PATENT DOCUMENTS 4,060,959 A 12/1977 Fiedler et al.
4,924,654 A 5/1990 Langen et al.
6,189,302 B1 * 2/2001 Kudo ..... B65B 11/54 294/902
7,296,390 B2 * 11/2007 Koke ..... B65B 31/024 53/202
7,650,729 B2 * 1/2010 Whittlesey ..... B65G 21/06 198/813
9,085,435 B2 * 7/2015 Jiwan ..... B65G 15/26
9,459,019 B2 * 10/2016 Runyan ..... B21D 43/02
2001/0022061 A1 * 9/2001 Resta ..... B65B 11/10 53/228
2004/0016213 A1 * 1/2004 Loperfido ..... B65B 25/146 53/461
2006/0096244 A1 * 5/2006 Cere' ..... B65B 9/026 53/399
2007/0189762 A1 * 8/2007 Cere ..... B65B 41/14 396/320
2007/0289253 A1 12/2007 Miller
2009/0294246 A1 * 12/2009 Pogue ..... B65G 67/08 198/313
2011/0056797 A1 * 3/2011 Tsai ..... B65H 31/3009 198/374
2014/0217258 A1 * 8/2014 Cere' ..... B65B 11/025 104/118
2016/0214752 A1 * 7/2016 Ono ..... B65B 49/02
2017/0217611 A1 * 8/2017 Cappi ..... B65B 11/12
2022/0135264 A1 * 5/2022 Gerri ..... B65H 16/08 242/563.1

* cited by examiner

ADJUSTABLE PACKAGING MACHINE

FIELD

The present disclosure relates generally to packaging machines, and in particular, packaging machines configured to form and apply a wrapper to a package.

BACKGROUND

Rolls of product, for example rolls of household tissue, toilet paper or paper towels, typically need to be packaged for distribution and commercial sale. While rolls of products are sometimes individually wrapped, multiple rolls can be organized into bundles and packaged together. These bundles can be arranged in boxes, crates, bags or other containers, or they can be wrapped in a packaging material, such as paper or plastic.

Packaging machines for rolls of product can be configured to form a wrapper for packaging individual rolls or bundles from a web (i.e., a large sheet) of packaging material, which is often stored in a web roll. To form the wrapper, the web is drawn from the roll at an unwinding station before being cut to size based on the desired wrapper dimensions. The wrapper can then be separated from the web and transported to a wrapping station where the rolls or bundle of rolls will be wrapped in the wrapper.

SUMMARY

To form the wrapper, packaging machines can utilize a shearing conveyor system. After being unwound from the roll, the web of packaging material may be scored to form a break line before moving onto a conveyor assembly that advances the web towards the wrapping station. The conveyor system may be configured to create a shearing force that breaks the web at the break line to form the wrapper. The wrapper may continue along the conveyor system until it is wrapped around a package at a wrapping station.

Packaging machines such as these may be configured to form different size wrappers to package products of various dimensions by scoring the web at different intervals. The size of the wrapper may be increased by scoring the web less frequently, thereby leaving larger gaps between break lines to from longer wrappers. Shorter wrappers for smaller products may be produced by scoring the web more frequently to leave smaller gaps between subsequent break lines. Since the smaller wrappers are shorter, they will need to travel a greater longitudinal distance on the conveyor system after being separated from the web than the larger, longer wrappers need to travel. This increased transport distance may increase in the instances of errors (for example, misalignment, skewing, or other imperfections), resulting in packaging rejections.

The present disclosure relates to an adjustable packaging machine including a sliding conveyor assembly that moves relative to the wrapping station. The conveyor assembly may be moved towards or away from the wrapping station to adjust the travel distance for a wrapper from the shear point to the elevator on the wrapping assembly based on the size of the wrapper and/or the product to be wrapped. By doing so, the total travel distance of the wrapper may be kept to a minimum, regardless of the size of the wrapper.

Embodiments of a packaging machine may be configured to form a wrapper from a web of packaging material and secure the wrapper to a package. The packaging machine may include an unwind station base configured to support the web of packaging material, a wrapping station frame spaced apart from the unwind station base, a carriage slidably mounted on the unwind station base, and a scoring blade configured to selectively score the web to form a break line extending between opposite lateral sides of the web. A conveyor assembly may be secured to the carriage and can extend from the unwind station base to the wrapping station frame. The conveyor assembly may include a first set of conveyors configured to advance the web towards the wrapping station frame at a first speed and a second set of conveyors configured to advance the web towards the wrapping station frame at a second speed that is greater than the first speed, wherein the difference in conveyor speeds causes the wrapper to break apart from the web at the break line. The packaging machine may additionally include an elevator secured to the wrapping station frame and configured to lift the package vertically into engagement with the wrapper. The carriage may be configured to selectively slide in a longitudinal direction relative to the wrapping station frame to adjust a travel distance of the wrapper to the elevator.

Embodiments of an unwind station may be configured to form a wrapper from a web roll and supply the wrapper to a wrapping station. The unwind station may include a base configured to rotatably support the web roll, a carriage configured to selectively slide in a longitudinal direction on the base, the carriage including a feed roller configured to unwind the web from the web roll, and a rotating blade configured to periodically score the web to form a break line extending between opposite lateral sides of the web. The unwind station may further include a first conveyor arm and a second conveyor arm that may project longitudinally outward from the carriage, and the first conveyor arm and the second conveyor arm may each include a low-speed conveyor configured to transport the web to a high-speed conveyor. The high-speed conveyor may be configured to separate the wrapper from the web as the break line passes a shear point between the low-speed conveyors and the high-speed conveyors.

Various other features, objects, and advantages will be made apparent from the following description taken together with the drawings.

BRIEF DESCRIPTION OF THE DRAWINGS

The present disclosure is described with reference to the following Figures.

DETAILED DESCRIPTION

Figure 1:
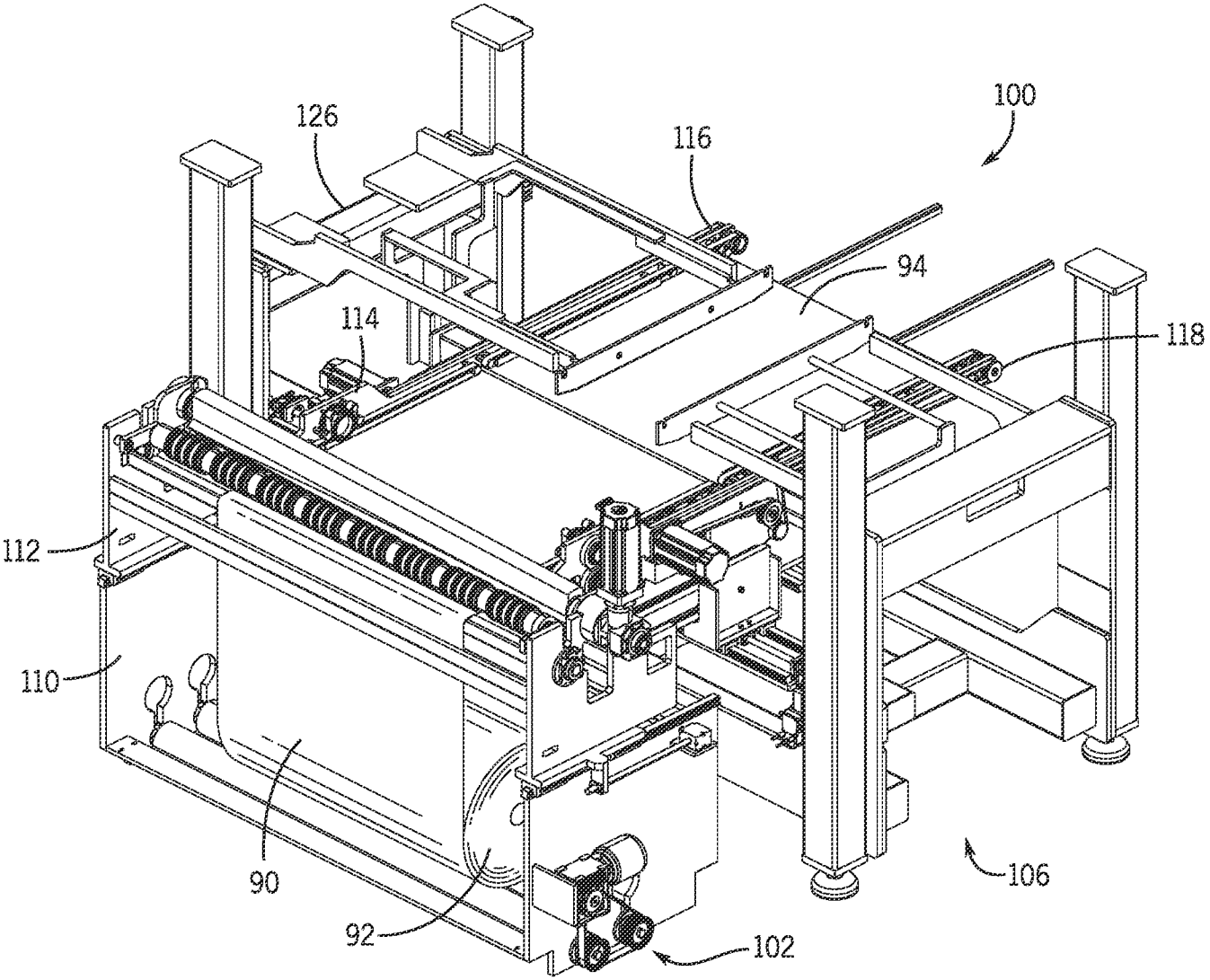
FIG. 1 is a perspective view of an unwind station and wrapping station for a packaging machine in a retracted position.
Figure 2:
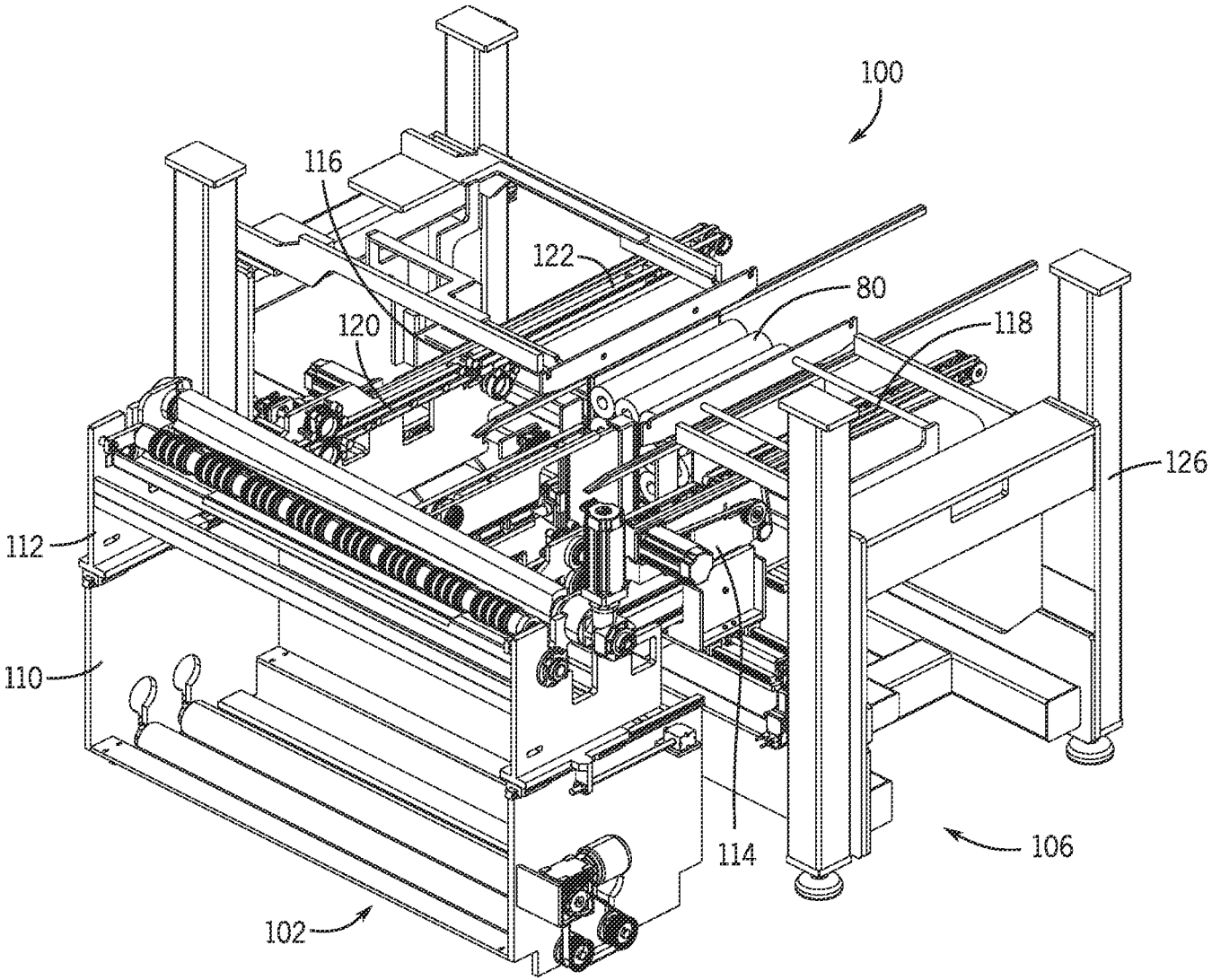
FIG. 2 is a perspective view of the unwind station and the wrapping station for a packaging machine of FIG. 1 with the packaging material omitted.
Figure 3:
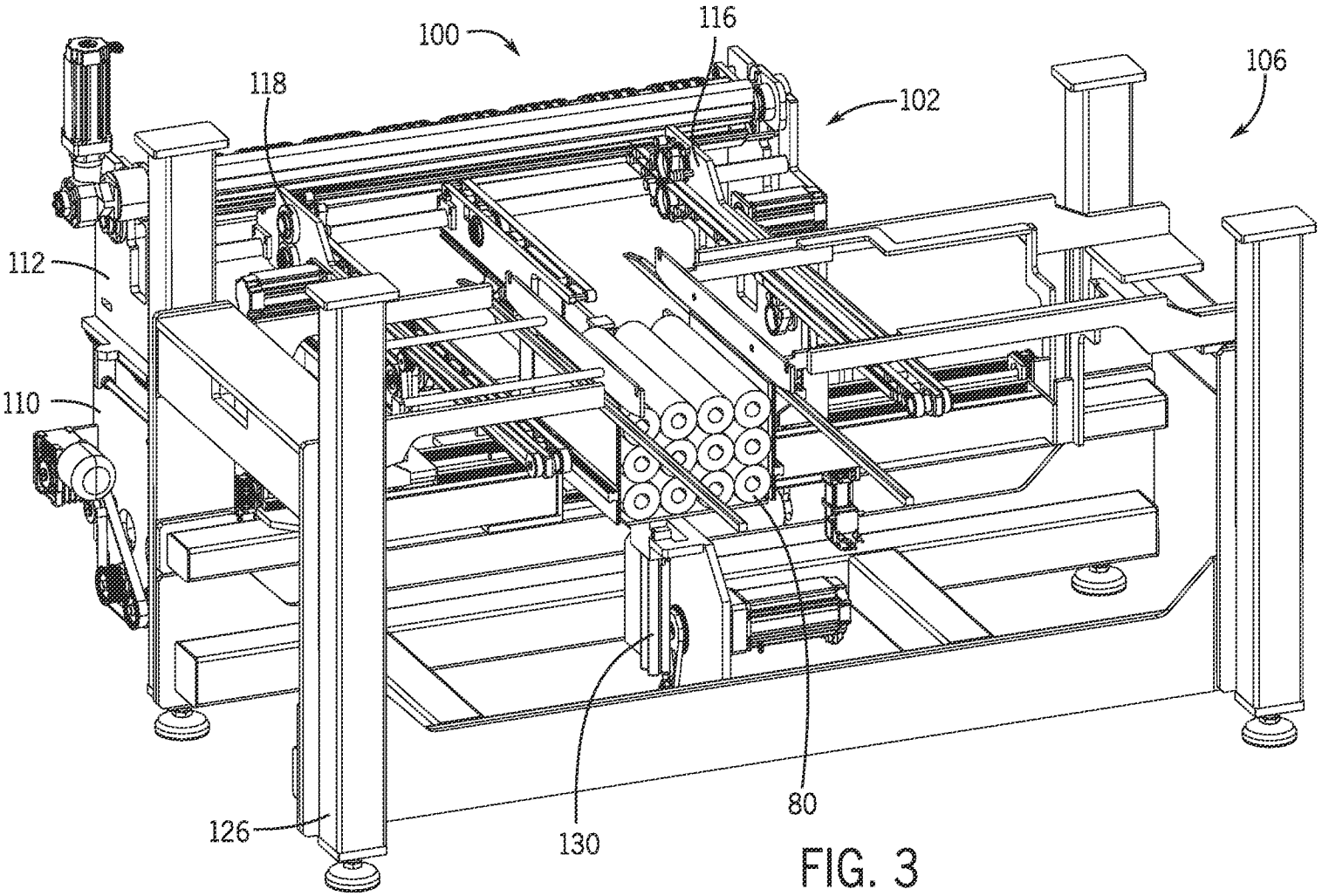
FIG. 3 is another perspective view of the unwind station and the wrapping station for a packaging machine of FIG. 2.
Figure 4:
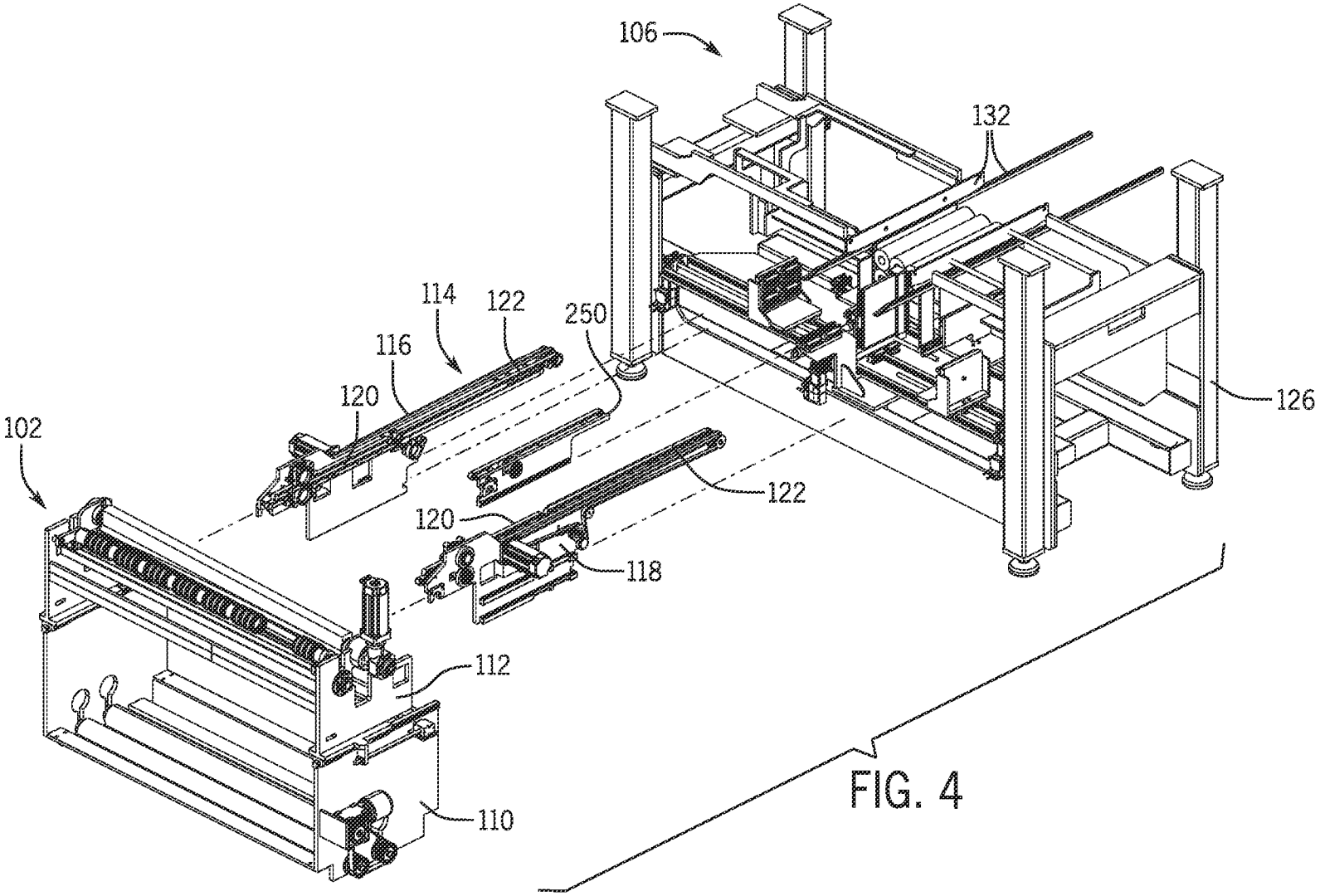
FIG. 4 is an exploded perspective view of the unwind station and wrapping station for a packaging machine of FIG. 3.

In the present description, certain terms have been used for brevity, clarity and understanding. No unnecessary limitations are to be inferred therefrom beyond the requirement of the prior art because such terms are used for descriptive purposes only and are intended to be broadly construed. The different methods and assemblies described herein may be used alone.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," "back," "left" or "right" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements or machines from another.

Referring now to the figures, FIGS. 1-4 illustrate an embodiment of an adjustable packaging machine 100 configured to form wrappers 94 for packages 80 (such as a product roll or a bundle of product rolls) of various different sizes. The packaging machine 100 may include an unwind station 102 configured to form a wrapper 94 from a web roll 92 and a wrapping station 106 configured to apply the wrapper 90 to a package 94. The unwind station 102 may include a base 110 configured to rotatably support the web roll 92 and a sliding carriage 112 mounted on the upper end of the base 110. A conveyor assembly 114 including a set of high-speed conveyors and low-speed conveyors mounted on left and right conveyor arms 116, 118 may be coupled to the carriage 112 and extend in a longitudinal direction to a frame 126 of the wrapping station 106. The conveyor assembly 114 is configured to break a wrapper 94 away from the web 90 and transport the wrapper 94 into the wrapping station 106. To control the size of the wrapper, a user may adjust the longitudinal positions of the carriage 112 and the conveyor assembly 114 relative to an elevator 130 secured to the wrapping station frame 126 by sliding the carriage 112 and the conveyor assembly 114 longitudinally on their respective supports.

The packaging machine 100 includes elevator 130 secured to the wrapping station frame 126 below the conveyor assembly 114. The elevator 130 receives the package 80 prior to wrapping. Once the wrapper 94 is moved into a position above the elevator 130, the elevator 130 can lift the package 80 upwardly, pressing it into the wrapper 94. The elevator 130 may continue to push the package 80 and wrapper 94 upwardly as guides 132 on the wrapping station frame 126 press the wrapper 94 onto the sides of the package 80. Additional packaging machinery (not shown) may then be used to fully enclose the package 80 in the wrapper.

Figure 5:
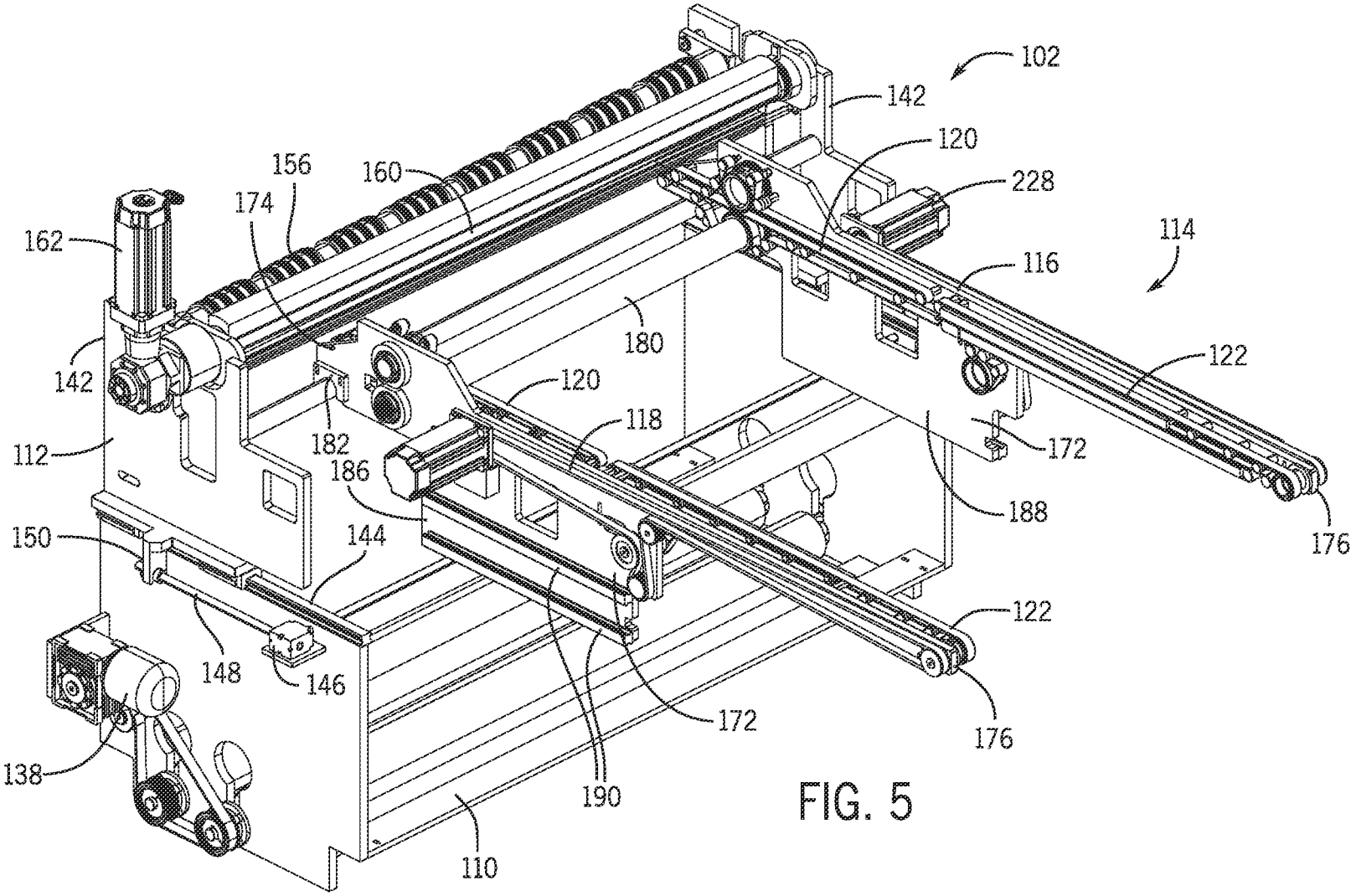
FIG. 5 is a perspective view of the unwind station and left and right conveyor arms from the packaging machine of FIG. 4.
Figure 6:
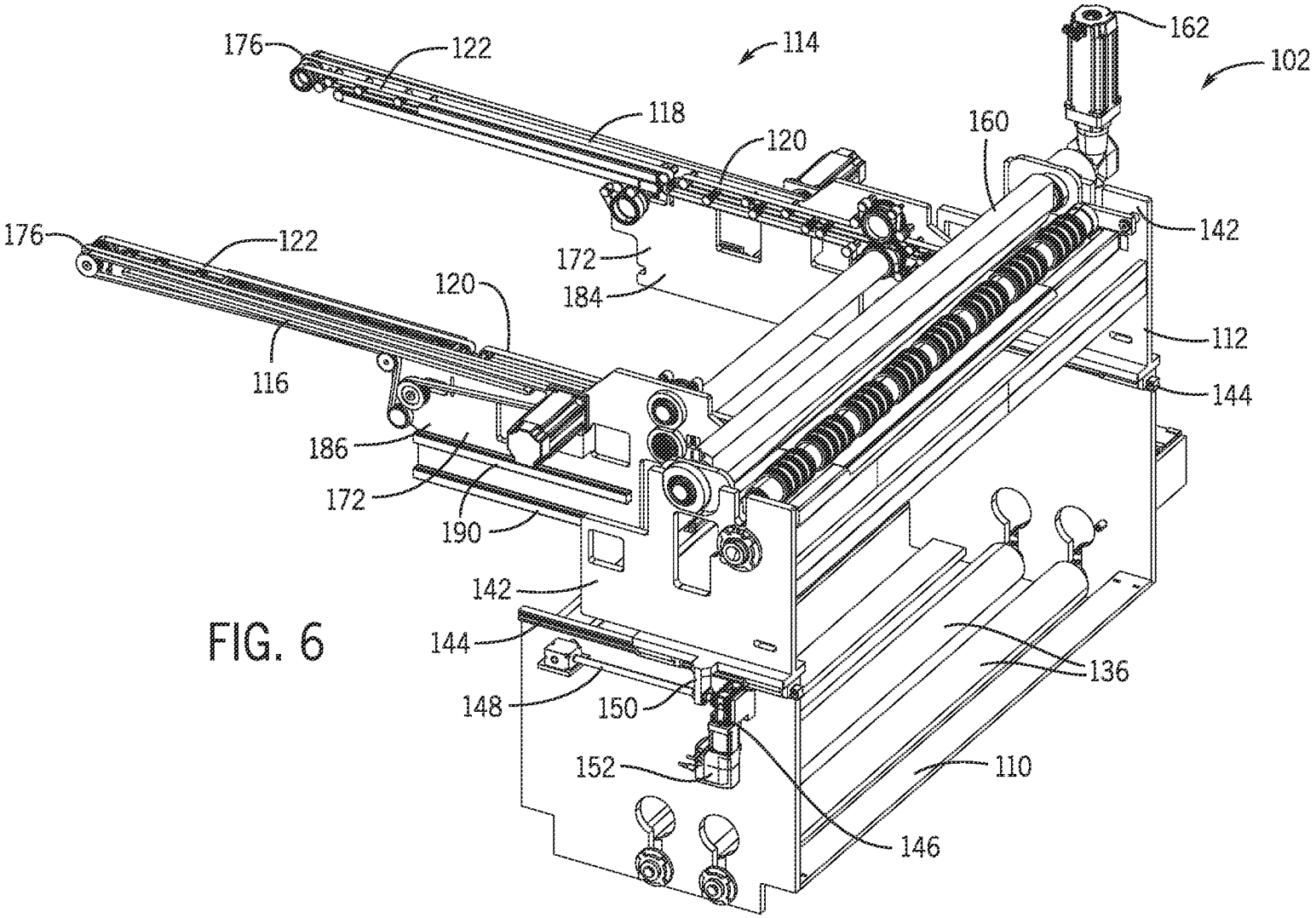
FIG. 6 is another perspective view of the unwind station and left and right conveyor arms of FIG. 5.
Figure 7:
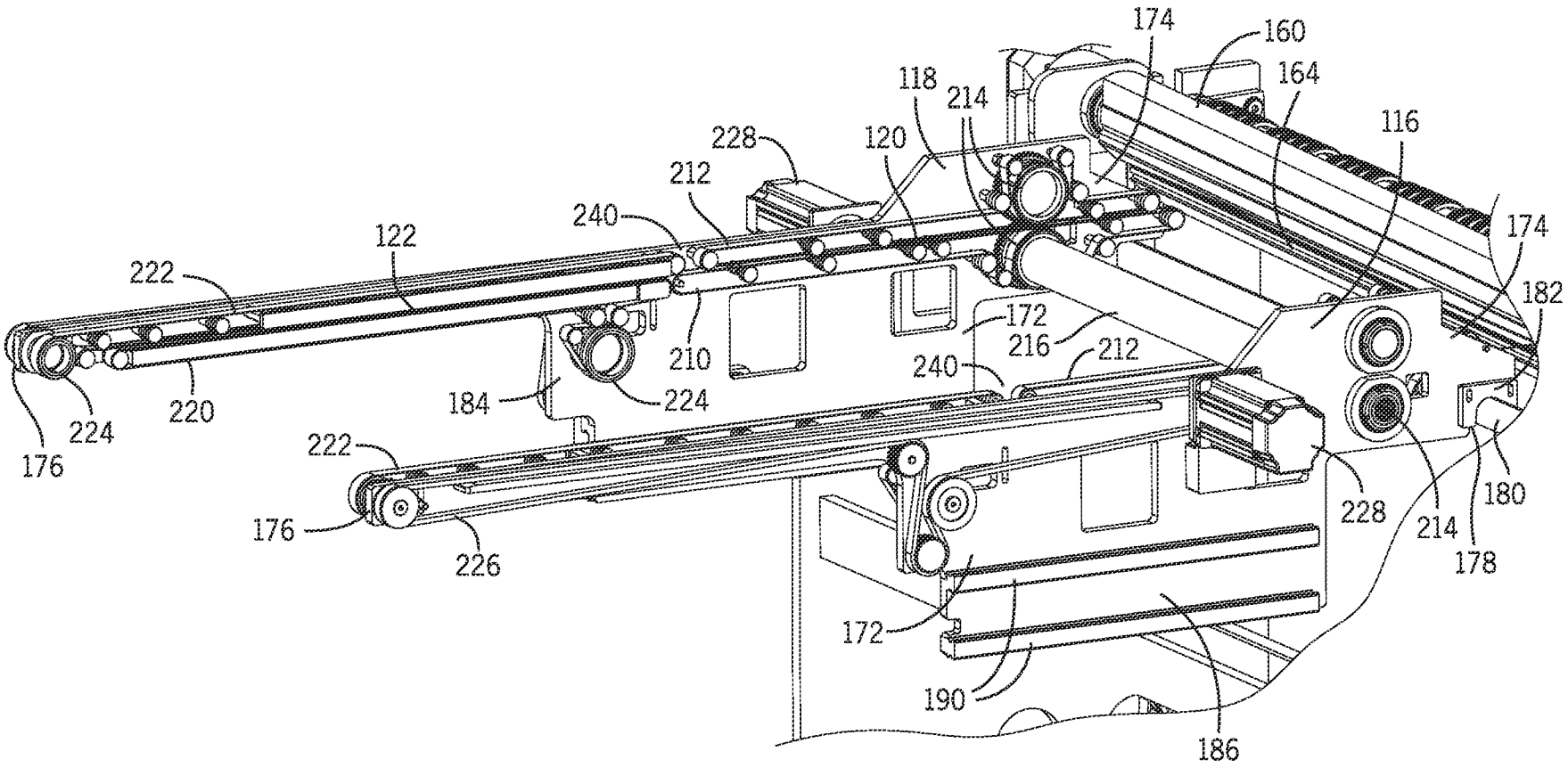
FIG. 7 is a detailed perspective view of the conveyor arms and unwind station of FIG. 6.
Figure 13:
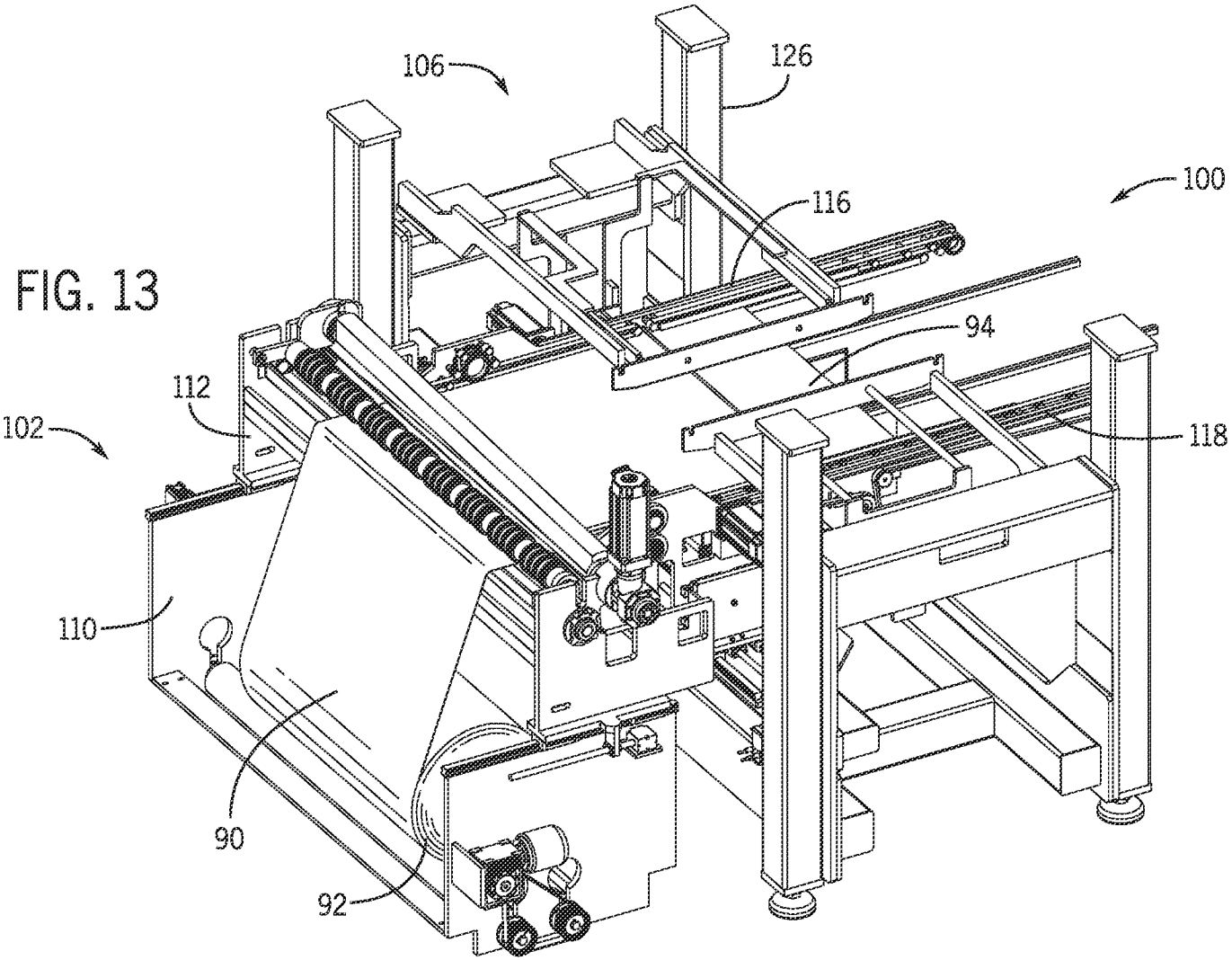
FIG. 13 is a perspective view of the packaging machine of FIG. 12 with the carriage and conveyor assembly in an extended position.
Figure 14:
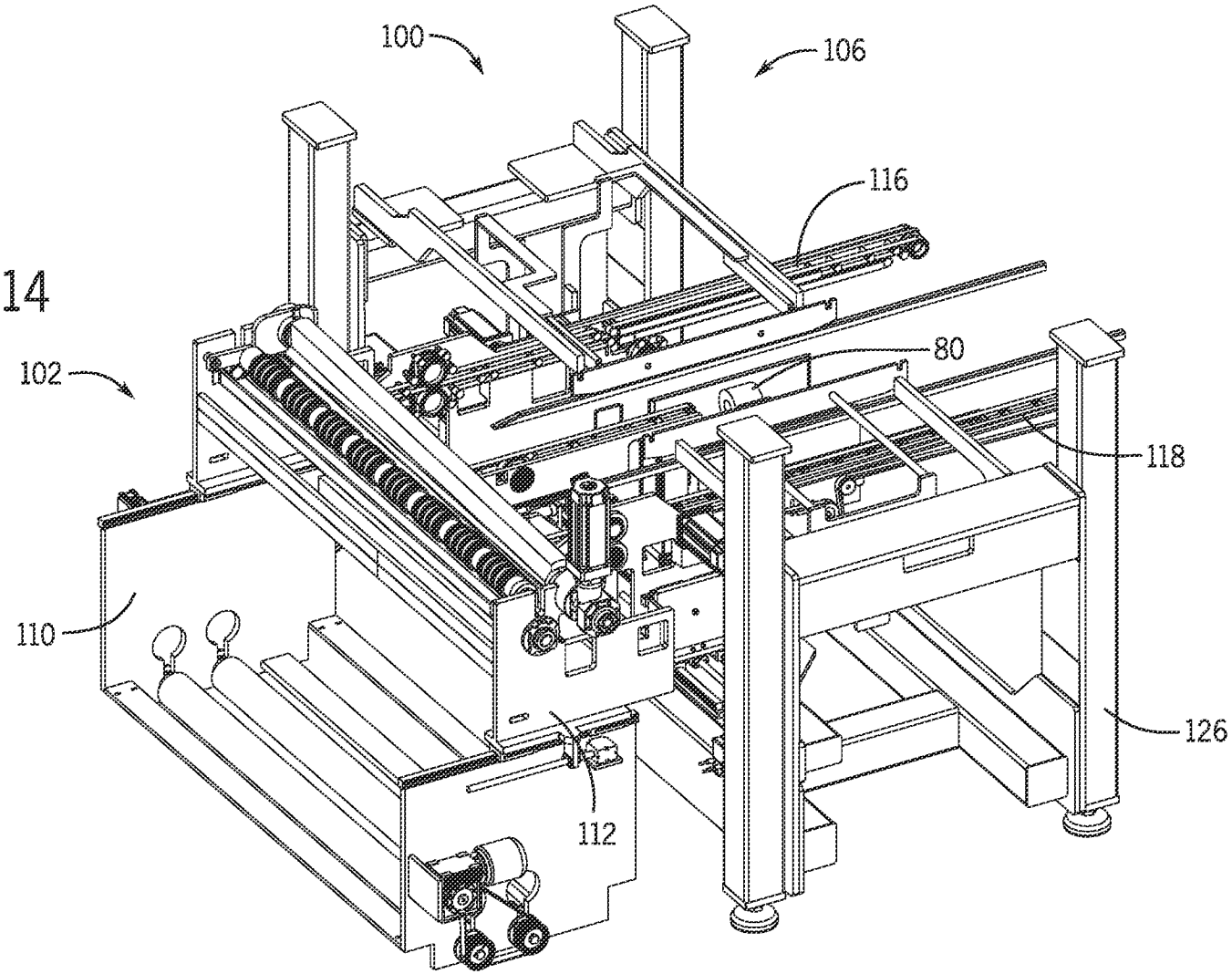
FIG. 14 is a perspective view of the packaging machine of FIG. 13 with the packaging material omitted.
Figure 15:
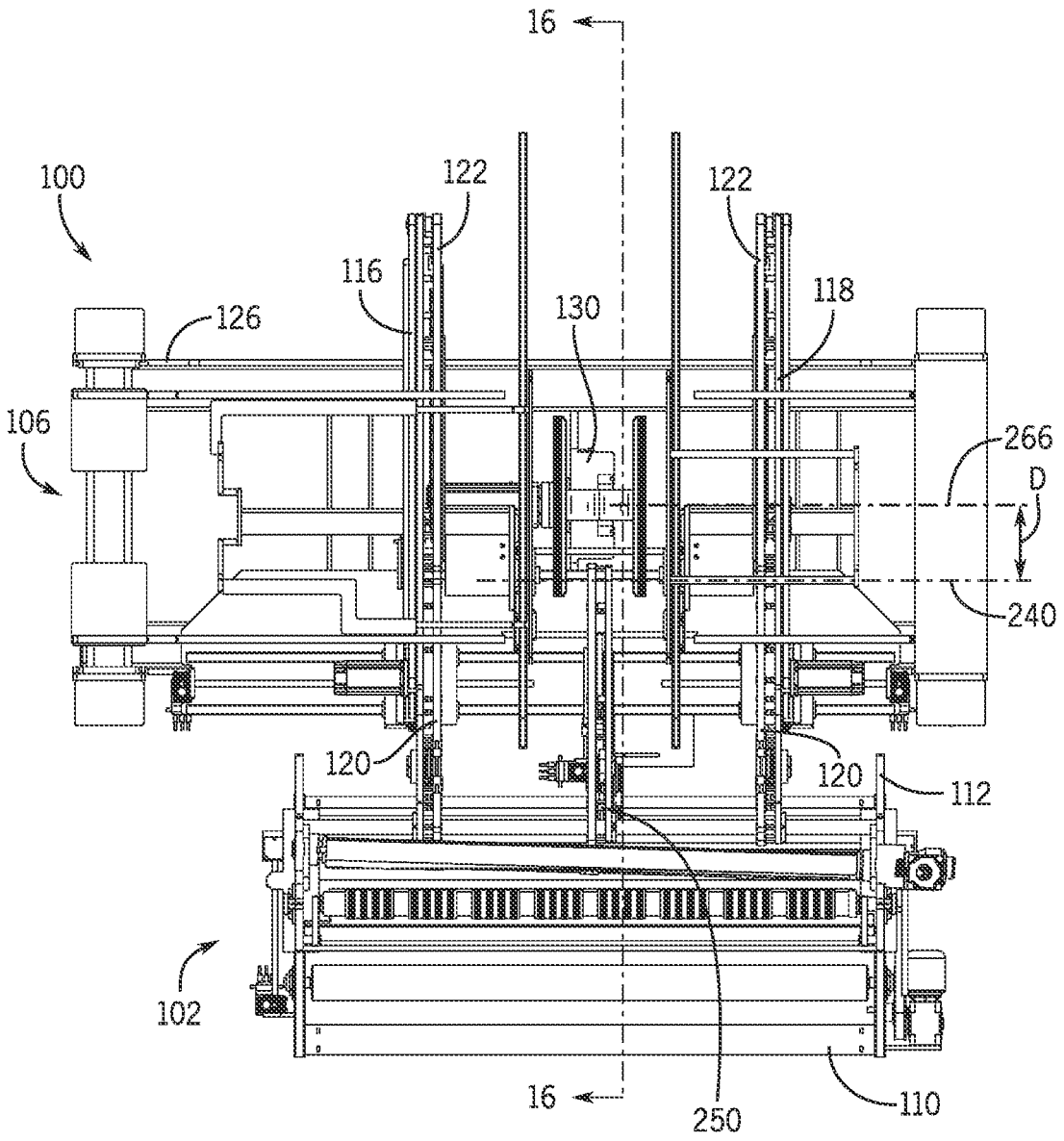
FIG. 15 a top-down view of the packaging machine of FIG. 14 with the carriage and conveyor assembly in the extended position.
Figure 16:
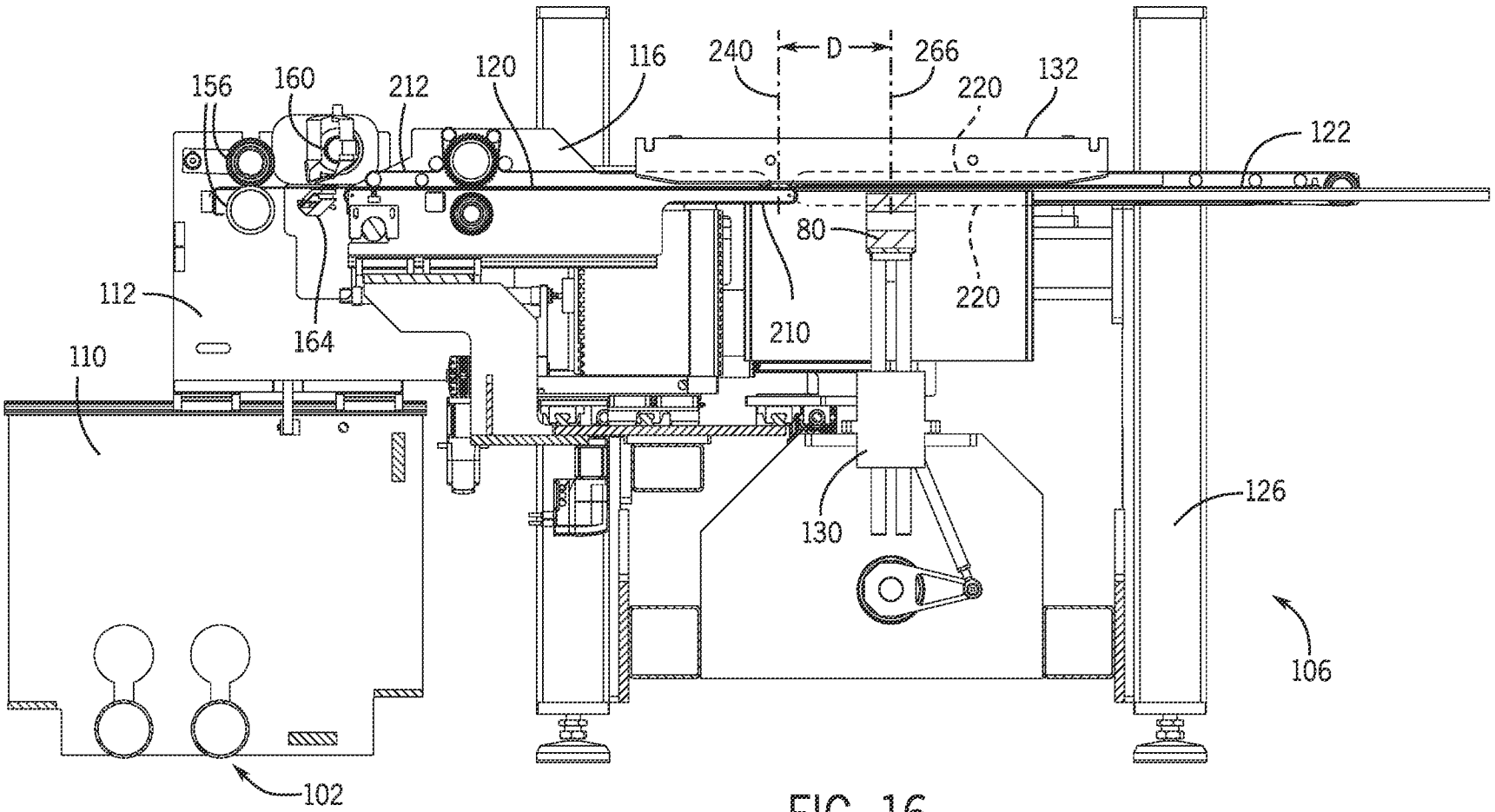
FIG. 16 is a side cross sectional view of the packaging machine of FIG. 15 with the carriage and conveyor assembly in the extended position.

Having generally described features of a packaging machine 100, the details of its components and their structure and features will now be discussed. Referring to FIGS. 5-7, the base 110 of the unwind station 102 may include support rollers 136 configured to rotatably support the web roll 92 (see FIGS. 1 and 13). The support rollers 136 may be positioned proximate a lower end of the unwind station base 110 and can extend between opposite lateral sides thereof. The support rollers 136 may be linked by a drive belt and such that they may be simultaneously rotated by a motor 138. This may be useful, for example, in order to unroll the web 90 of packaging material from the web roll 92 when it is received on the unwind station 102. Some embodiments of an unwind station may include a differently configured web roll support arrangement. For example, a web roll may be mounted on a single roller or spool that extends through the center of the web roll. Additionally or alternatively, some embodiments may be configured with at least one unpowered support roller configured to rotate freely as the web is drawn from a web roll.

The carriage 112 may include lateral side panels 142 linked by transverse structural members and can be slidably received on rails 144 that extend longitudinally along opposite lateral side of the base 110 of the unwind station 102. In some embodiments, sliding movement of the carriage 112 may be controlled by a ball screw actuator 146. For example, threaded rods 148, which extend along the lateral sides of the base 110 perpendicular to the rails 144, are configured to be engaged by positioning members 150 extending from the side panels 142 of the carriage 112. When the threaded rods 148 are rotated, threaded engagement between the threaded rods 148 and positioning members 150 causes the carriage 112 to slide along the rails 144, moving longitudinally relative to the base 110. In the illustrated embodiments, the threaded rods 148 may be operatively linked to each other by a shaft 148 that extends laterally across the carriage 112. This may be useful, for example, so that both of the threaded rods 148 can be simultaneously driven by one motor 152.

Some embodiments of a packaging machine may include a different actuation system for moving the carriage. For example, the base of an unwind station may include threaded rods that are operatively linked by a different linkage configuration, while another embodiment may include independently driven threaded rods. Additionally or alternatively, a different type of electro-mechanical, hydraulic, or pneumatic linear actuator may be configured to control longitudinal movement of the carriage.

To draw the web 90 of packaging material from the web roll 92 and towards the conveyor assemblies 116, 118, the carriage 112 may include feed rollers 156 that extend between the opposing lateral side panels 142 of the carriage 112. In some embodiments, the feed rollers may be textured to grip the web 90, while other embodiments may include feed rollers without any specialized texture. Additionally or alternatively, a packaging machine may include at least one feed roller that is position on the base of the unwind station, the conveyor assembly, and/or any other part of the packaging machine.

Figure 12:
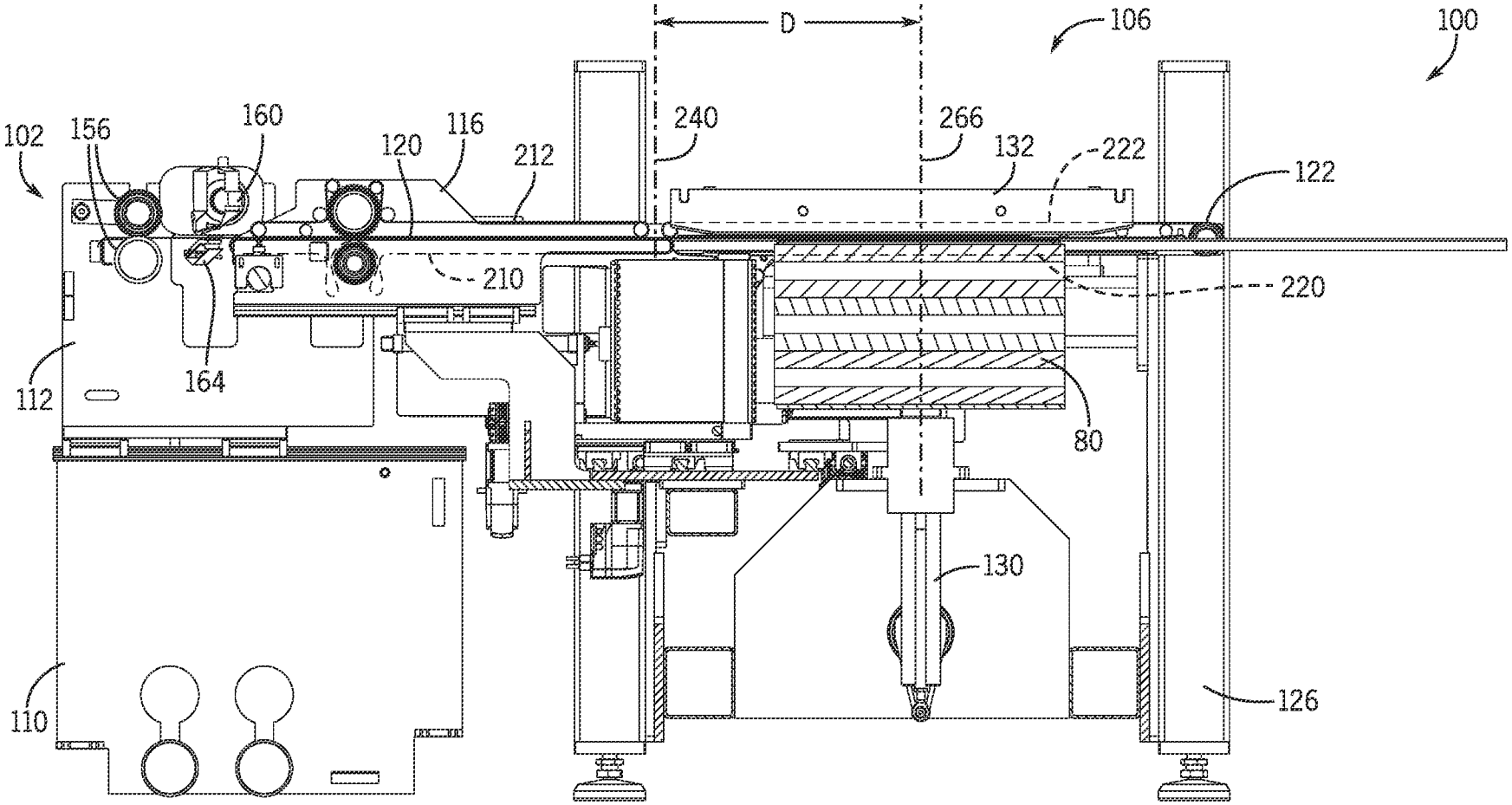
FIG. 12 is a side cross sectional view of the packaging machine of FIG. 11 with the carriage and conveyor assembly in the retracted position.

Additionally or alternatively, the carriage 112 may include a scoring blade 160 configured to score the web 90 as it moves across the carriage to the conveyor assemblies 116, 118. The illustrated scoring blade 160, for example, extends between opposite lateral sides of the carriage 112 and is configured to be rotated by a motor 162. As the scoring blade 160 rotates, an edge of the blade 160 engages the top surface of the web 90 and presses it against a cutting surface 164 positioned below the web 90 (See, e.g., FIG. 12). As the web 90 is pressed against the cutting surface 164, the scoring blade 160 may be configured to form a grove and/or a series of perforations across the web 90 without cutting it, thereby forming break line (i.e., a weak point) in the packaging material extending across the web 90. In the illustrated embodiments, the scoring blade 160 is configured to form a break line that extends laterally across the web 90 such that the break line is perpendicular to the longitudinal direction of travel of the web 90. Other embodiments, however, may be configured to form a break line that may be angled and/or curved. Additionally or alternatively, some embodiments of a packaging machine may be configured with a different mechanism for scoring the packaging material web.

Embodiments of a packaging machine may include a conveyor assembly that links the unwind station to the wrapping station. In the illustrated embodiments, for example, the conveyor assembly 114 may include a left conveyor arm 116 and a right conveyor arm 118 that are each configured to be connected to the carriage 112 and supported on the frame 126 of the wrapping station 106 by a sliding support 170 (see, e.g., FIG. 9). Each of the conveyor arms 116, 118 includes a generally planar arm body 172 that extends from a back end 174 to a front end 176. As shown in FIG. 7, a notch 178 formed in the back end 174 of the arm body 172 is configured to receive a positioning bar 180 that extends across the carriage 112, and a retention plate 182 can be secured to the arm body 172 to retain the positioning bar 180 in the notch 178, thereby fixing the longitudinal position of the conveyor arm 116, 118 relative to the carriage 112.

When the conveyor arms 116, 118 are connected to the carriage 112, an interior surface 184 of the arm bodies 172 faces laterally inward towards the opposing conveyor arm 116, 118, and an exterior surface 186 of the arm bodies 172 faces laterally outward. As illustrated in FIG. 7, one of the low-speed conveyors 120 and one of the high-speed conveyors 122 may be positioned on the interior surface 184 of each of the conveyor arms 116, 118. The low-speed conveyors 120 may include a lower belt 210 and an upper belt 212 that are configured to make contact with each other in order to grip the lateral edge of the web 90 between the belts 210, 212. The lower and upper belts 210, 212 are driven by geared drive pulleys 214 that are meshed with each other so that the lower and upper belts 210, 212 run in the same longitudinal direction and at the same speed. Additionally or alternatively, some embodiments of a conveyor assembly may be configured so that the low-speed conveyors on the left and right conveyor arms are operatively linked so that they run at the same speed. As illustrated in FIGS. 5-7, for example, the left conveyor arm 116 and the right conveyor arm 118 are in lateral alignment so that shaft 216 can extend between two corresponding geared drive pulleys 214, linking the low-speed conveyors 120. This may be useful, for example, so that a single motor can be used to drive the low-speed conveyors on the left and right conveyor arms 116, 118. Some embodiments, however, may include low-speed conveyors that are linked by a different linkage assembly, and/or the low-speed conveyors may be separately driven so that their speeds are independently controllable.

The high-speed conveyor 122 on each conveyor arm 116, 118 includes a lower belt 220 and an upper belt 222 configured to run in the same direction and grip the lateral edge of the web 90. The belts 220, 222 of the high-speed conveyors 122 are driven by drive pulleys 224 that are linked to each other by a drive belt 226 arranged on the exterior surface 186 of the arm bodies 172. The drive belt 226 additionally connects the lower and upper belts 220, 222 to corresponding motors 228 configured to independently power the each of the high-speed conveyors 122. This may be useful, for example, in order in independently control the speed of each of the high-speed conveyors 122. Some embodiments, however, may be configured with high-speed conveyors that are not independently controlled.

The conveyor sets 120, 122 may be configured to make contact with and convey the web 90 along the full length of the conveyor arms 116, 118. The low-speed conveyors 120 begin proximate the back end 174 of each arm body 172 and are configured to convey the web 90 to an interchange between the low-speed conveyors 120 and the high-speed conveyors 122. The high-speed conveyors 122 begin at the interchange and end proximate the front end 176 of the arm bodies 172. At the interchange, the ends of the low-speed belts 210, 212 and the ends of the high-speed belts 220, 222 are offset from each other such that there is a gap between the upper low-speed belt 212 and the upper high-speed belt 222 and the lower low-speed belt 210 overlaps with the upper high-speed belt 222. This interchange configuration may be useful, for example, to provide a smooth transition between the low-speed conveyors 120 and the high-speed conveyors 122. Additionally, the interchange may provide a shear point 240 where the wrapper 94 may be torn away from the web 90 as the break line passes through the interchange.

Figure 8:
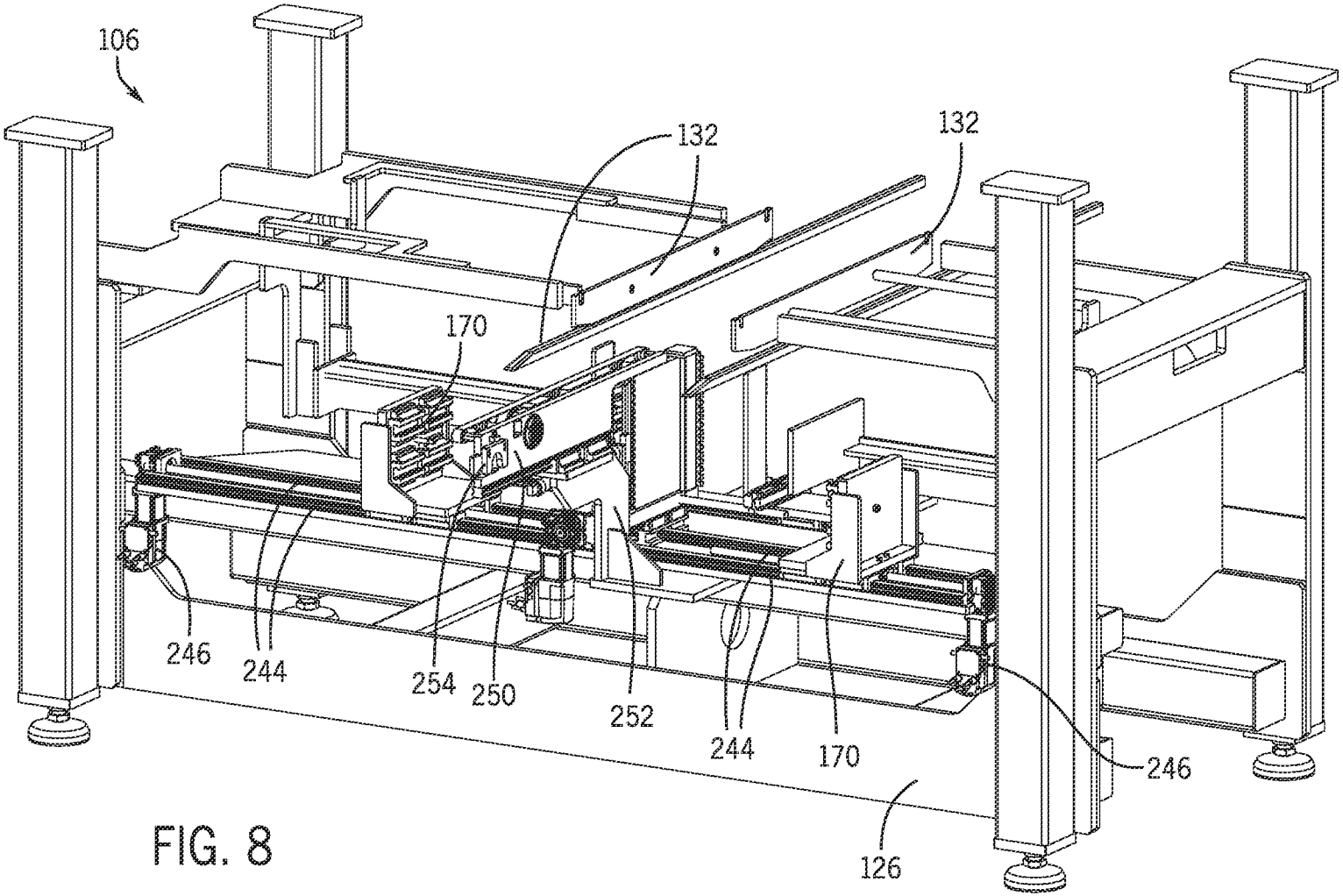
FIG. 8 is a perspective view of the frame of the wrapping station with the central conveyor arm from the packaging machine of FIG. 4.
Figure 9:
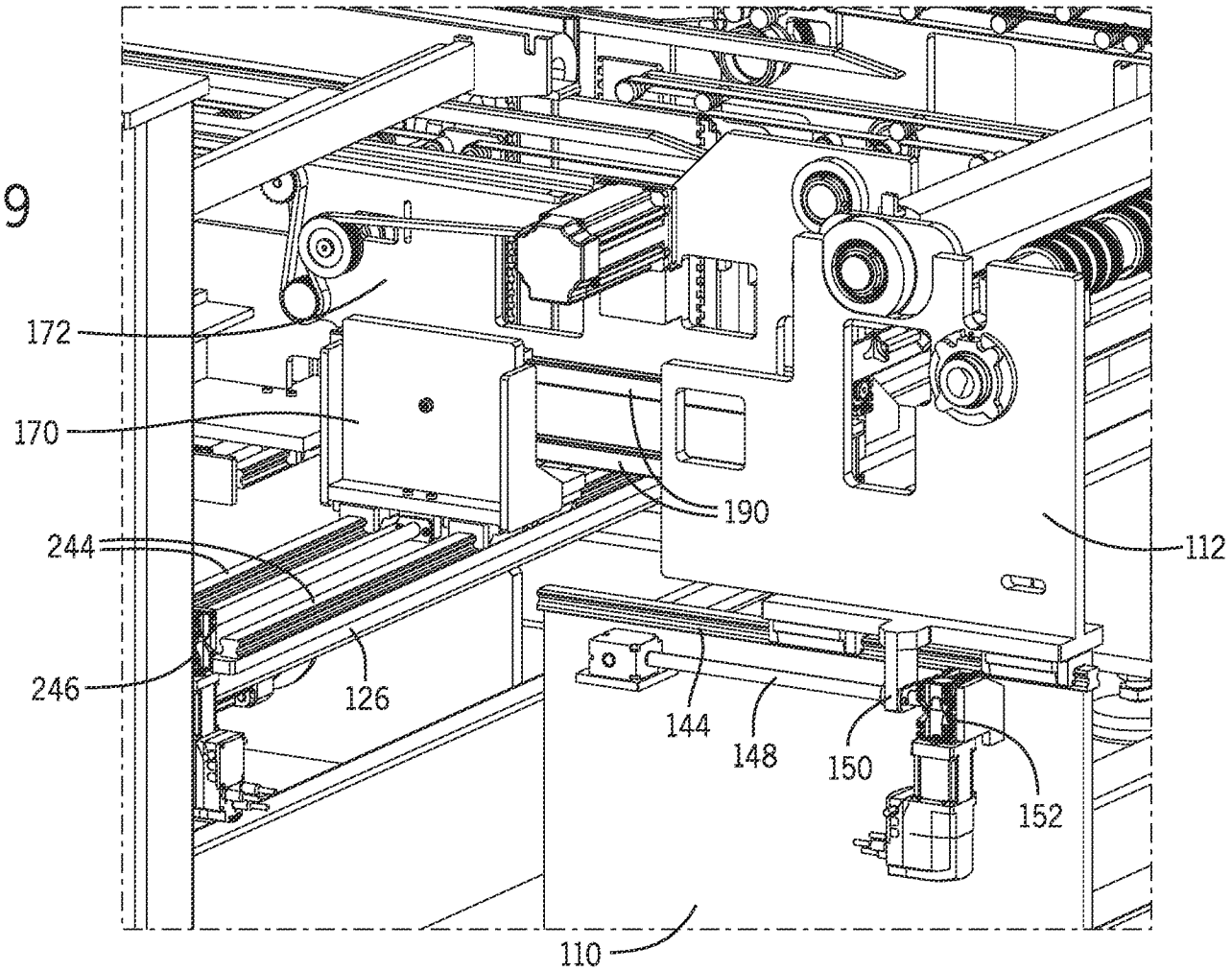
FIG. 9 is a detailed perspective view of the packaging machine of FIG. 4.

As previously mentioned, the left and right conveyor arms may be slidably supported on the wrapping station frame. For example, as illustrated in FIGS. 8 and 9, the frame 126 of the wrapping station 106 may include sliding supports 170 that are configured to slidably receive rails 190 that extend along at least one of the interior surface 184 and the exterior surface 186 of the conveyor arms 116, 118. The sliding interface between the conveyor arms 116, 118 and the sliding supports allows the conveyor arms 116, 118 to move relative to the wrapping station 106 along a longitudinal direction with the carriage 112.

In some embodiments, the sliding supports may additionally allow for lateral movement of the conveyor arms. For example, as illustrated in FIG. 8, each of the sliding supports 170 is slidably received on rails 244 that extend laterally between opposite sides of the frame 126 of the wrapping station 106. A linear actuator 246 may be operatively connected to each sliding supports 170 and can be configured to control lateral movement of the sliding supports 170 along the rails 244. Because the connection between the conveyor arms 116, 118 and the positioning bar 180 of the carriage 112 allows for lateral movement of the conveyor arms 116, 118, the linear actuators 246 may be used to adjust the lateral positions of the conveyor arms 116, 118. This may be useful, for example, in order to change the distance between the left conveyor arm 116 and the right conveyor arm 118 based on the width of the web 90, or to align a centerline of the conveyor assembly 114 with a lateral midpoint of the elevator 130.

Figure 10:
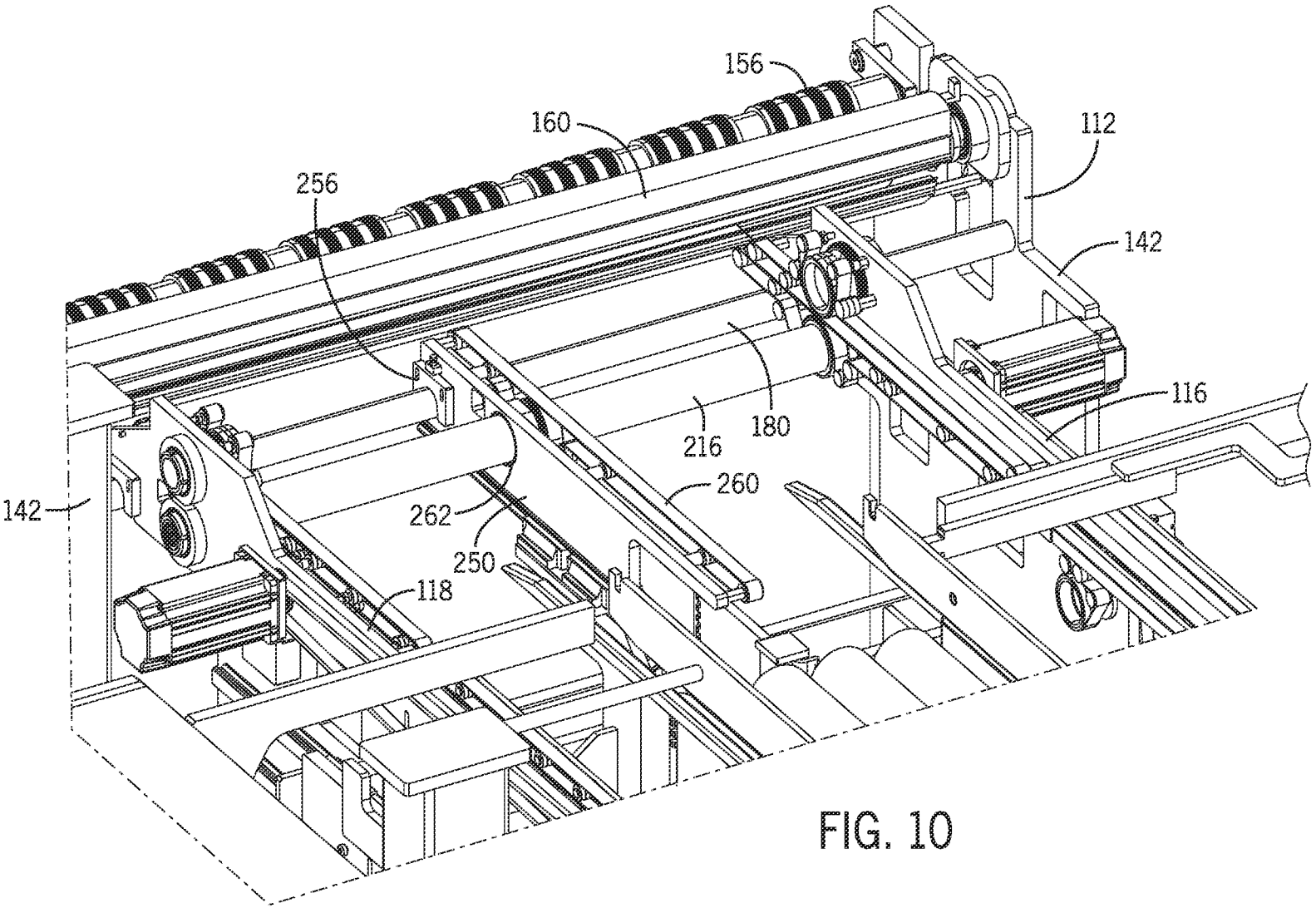
FIG. 10 is another detailed perspective view of the packaging machine of FIG. 9.
Figure 11:
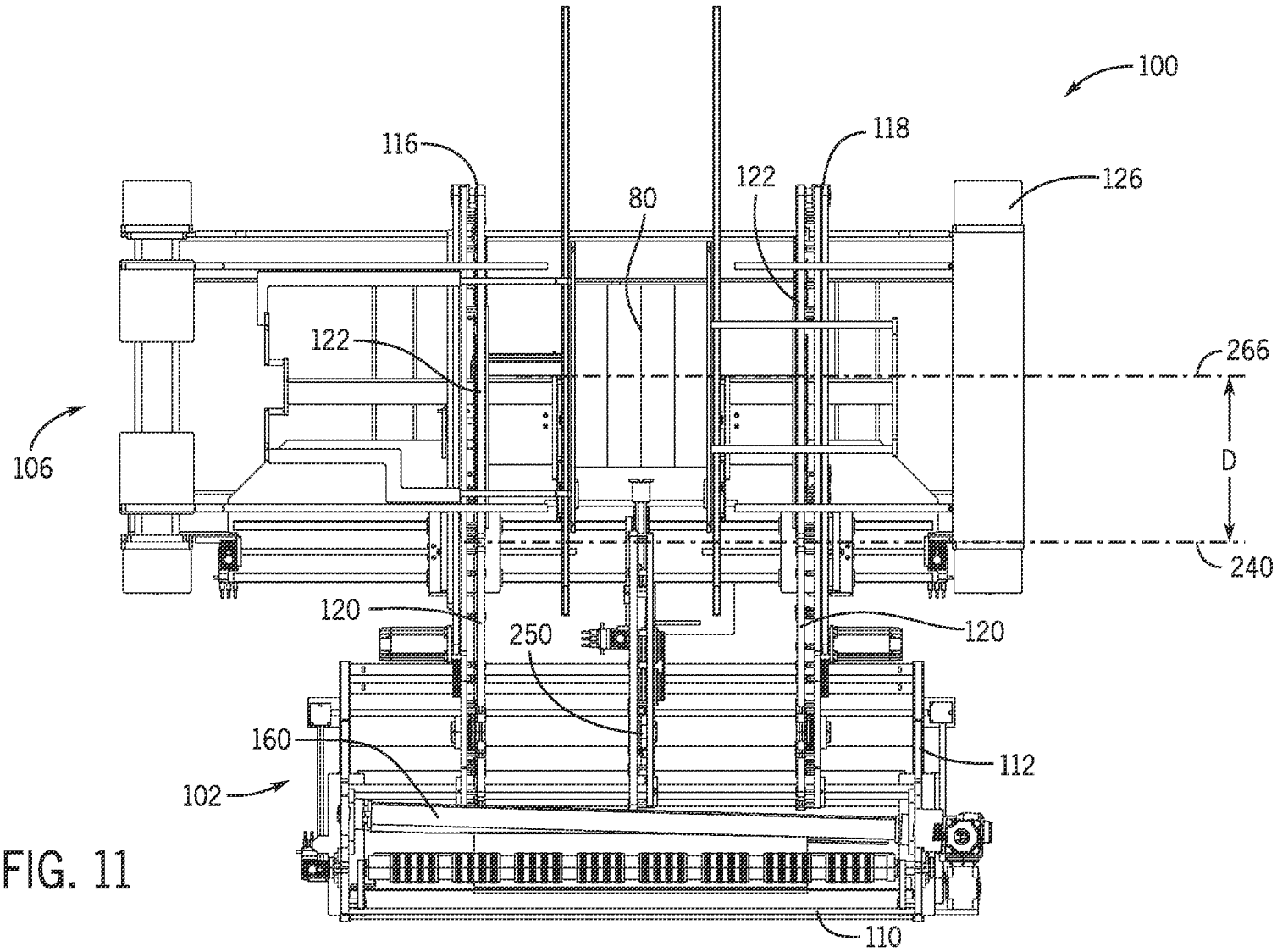
FIG. 11 is a top-down view of the packaging machine of FIG. 10 with the carriage and conveyor assembly in the retracted position.

Some embodiments of a packaging machine may include a conveyor assembly with additional conveyors. In the illustrated embodiments, for example, the conveyor assembly 114 may include a central conveyor arm 250 configured to be positioned between the left conveyor arm 116 and the right conveyor arm 118. As illustrated in FIGS. 8 and 10, the central conveyor arm 250 may be slidably received on a support member 252 that extends from the frame 126 of the wrapping station 106 and is positioned in alignment with the elevator 130. The body of the central conveyor arm 250 may include a notch 254 configured to receive the positioning bar 180 of the carriage 112, and a retention plate 256 can be configured to retain the positioning bar 180 in the notch 254, thereby linking longitudinal sliding movement of the central conveyor arm 250 to that of the carriage 112. In the illustrated embodiments, and referring specifically to FIG. 10, the central conveyor arm 250 may include a low-speed conveyor 120 with a single belt 260 configured to engage the lower surface of the web 90. The low-speed conveyor belt 260 may by positioned so that it is substantially in alignment with the lower belts 210 of the low-speed conveyors 120 on the left and right conveyor arms 116, 118. A drive pully 262 configured to drive the low-speed conveyor belt 260 may be engaged by the shaft 216 so that the low-speed conveyor belt 260 moves at the same speed as the low-speed conveyors 120 on the left and right conveyor arms 116, 118. In some embodiments, however, the packaging machine may include an additional motor configured to independently drive the central conveyor.

Embodiments of the adjustable packaging machine 100 may be configured to continuously produce wrappers 94 to be secured to products. As the web 90 of packaging material is advanced through the carriage 112, the scoring blade is continuously rotated by the motor 162 and a break line is formed across the web 90 each time the cutting edge of the scoring blade 160 engages the web 90. The web 90 is then drawn into the conveyor assembly 114 as the low-speed conveyors 120 on the left conveyor arm 116 and the right conveyor arm 118 respectively grip the left and right edges of the web 90, transporting the web 90 away from the unwind station 102 and towards the wrapping station 106. The central conveyor 250 may support the material in the center of the web 90 and maintain its speed as the web 90 travels along the conveyor assembly 114. Guides 132 positioned above and below the web 90 on the frame 126 of the wrapping station 106 may be configured to restrict vertical movement of the web 90 prior to activation of the elevator 130.

As the web 90 is passed from the low-speed conveyors 120 and the high-speed conveyors 122, the elevated speed of the high-speed conveyors 122 creates a shearing force localized proximate the shear point 240 that pulls the web 90 towards the front end 176 of the conveyor arms 116, 118. The strength of the shearing force, which may be based on at least one of the speed of the low-speed conveyors 116, the speed of the high-speed conveyors 118, the gripping force used to grip the web 90 with the conveyors 116, 118, and any other factors, can be selected so that unscored packaging material is not damaged by the shearing force as the web passes through the interchange. As the break line formed by the scoring blade 160 passes the shear point 240, however, the shearing force breaks the packaging material at the break line, thereby separating a wrapper 94 from the web 90. Subsequent wrappers are formed each time a break line in the web 90 passes through the shear point 240 at the interchange.

Embodiments of the packaging machine 100 may be adjusted to accommodate and produce wrappers 94 having different sizes by adjusting the longitudinal position of the conveyor assembly 114 relative to the elevator 130 and/or controlling the rate of rotation of the scoring blade 160. FIGS. 1-2 and 11-12 illustrate embodiments of the packaging machine 100 in a fully retracted configuration in which the carriage 112 is positioned at the maximum longitudinal distance from the frame 126 of the wrapping station 106. When the packaging machine 100 is in the fully retracted configuration, the longitudinal distance "D" between the shear point 240 and the longitudinal midpoint 266 of the elevator 130 (both denoted by dashed lines in FIGS. 11 and 12) is maximized. This may be useful, for example, in order to produce wrappers having long lateral lengths, which is limited by the distance "D" between the shear point 240 and elevator 130.

When packaging smaller products, however, it may be desirable to use a wrapper having a shorter longitudinal length. In such a scenario, the rotational speed of the scoring blade 160 may be increased in order to increase the frequency of blade-web contact, thereby creating break lines which are closer together. If the packaging machine is left in the fully retracted configuration, each of these smaller wrappers will need to travel a greater distance from the shear point to the elevator than the larger wrappers, which may increase the risk of wrapper misalignment and other errors. Some embodiments of a packaging machine may include optical sensors (not shown) that monitor a leading edge of a wrapper as it travels to the elevator. If skewing is detected, the rate of the high-speed conveyor 122 on one of the left or right conveyor arms 116, 118 may be increased or decreased relative to the other high-speed conveyor 122 in order to realign the wrapper and correct the error.

In the disclosed embodiments, the risk of such errors occurring may be reduced by moving the carriage 112 and the conveyor assembly 114 in towards the wrapping station 106. As the actuator 146 slides the carriage 112 and the conveyor assembly 114 towards the wrapping station 106 the distance between the shear point 240 and the elevator 130, is reduced. For example, FIGS. 13-16 an embodiment of the packaging machine 100 is a fully extended configuration in which the carriage 112 is positioned at the minimum longitudinal distance from the frame 126 of the wrapping station 106. With the packaging machine in the fully extended configuration, the longitudinal distance "D" between the shear point 240 and the longitudinal midpoint 266 of the elevator 130 and therefore the travel distance of the wrappers 94, is minimized. This may be useful, for example, in order to produce wrappers 94 having shorter longitudinal lengths without changing the footprint of the packaging machine 100. Embodiments the packaging machine 100 can be adjusted to produce wrappers having longitudinal dimensions which are different than the illustrated wrappers by moving the carriage 112 and conveyor assembly 114 to longitudinal positions between their fully retracted and fully extended positions.

In some embodiments, the longitudinal position of the carriage 112 and the conveyor assembly may be selected based on at least one of the size of the package to be wrapped and the size of the wrapper being produced. For example, the carriage 112 and the conveyor assembly 114 may be moved in a first longitudinal direction away from the base 110 and towards the wrapping station 106 in order to accommodate a small sized wrapper, or in a second longitudinal direction towards the base 110 and away from the wrapping station 106 in order to accommodate a large sized wrapper.

It is to be appreciated that features depicted in conjunction with any one of the illustrated embodiments may be used in conjunction with the features of any other embodiment of the invention. In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A packaging machine configured to form a wrapper from a web of packaging material and secure the wrapper to a package, the packaging machine comprising:

an unwind station base configured to support the web of packaging material;

a wrapping station frame spaced apart from the unwind station base;

a carriage slidably mounted on an upper end of the unwind station base;

a scoring blade configured to selectively score the web to form a break line extending between opposite lateral sides of the web;

a conveyor assembly having an upstream end secured to the carriage, the conveyor assembly extending from the upstream end at the unwind station base to the wrapping station frame, the conveyor assembly including a first set of conveyors configured to advance the web towards the wrapping station frame at a first speed and a second set of conveyors configured to advance the web towards the wrapping station frame at a second speed that is greater than the first speed, wherein the difference in conveyor speeds causes the wrapper to break apart from the web at the break line;

an elevator secured to the wrapping station frame and configured to lift the package vertically into engagement with the wrapper; and wherein the carriage is configured to selectively slide longitudinally relative to the wrapping station frame to adjust a travel distance of the wrapper to the elevator and a distance between the upstream end of the conveyor assembly and the elevator.

2. The packaging machine of claim 1, wherein the conveyor assembly includes a first conveyor arm configured to receive a first lateral edge of the web and a second conveyor arm configured to receive a second lateral edge of the web.

3. The packaging machine of claim 2, wherein the first set of conveyors includes a first conveyor on each of the first and second conveyor arms and the second set of conveyors includes a second conveyor on each of the first and second conveyor arms.

4. The packaging machine of claim 2, wherein the first conveyor arm and the second conveyor arm are coupled to the carriage such that longitudinal movement of the first conveyor arm and the second conveyor arm is linked to longitudinal movement of the carriage.

5. The packaging machine of claim 2, further comprising sliding supports configured to support the first conveyor arm and the second conveyor arm on the wrapping station frame; and wherein a sliding interface between the sliding supports and the first conveyor arm and the second conveyor arm permits longitudinal sliding movement of the first conveyor arm and the second conveyor arm relative to the wrapping station frame.

6. The packaging machine of claim 5, wherein the sliding supports are slidably engaged with lateral rails extending across the wrapping station frame.

7. The packaging machine of claim 6, further comprising a linear actuator configured to selectively adjust a lateral position of at least one of the sliding supports to adjust a distance between the first conveyor arm and the second conveyor arm.

8. The packaging machine of claim 2, wherein the conveyor assembly further comprises a third conveyor arm positioned between the first conveyor arm and the second conveyor arm.

9. The packaging machine of claim 8, wherein the first set of conveyors includes an additional conveyor positioned on the third conveyor arm.

10. The packaging machine of claim 1, wherein the wrapper is configured to break apart from the web as the break line passes a shear point between the first set of conveyors and the second set of conveyors.

11. The packaging machine of claim 10, wherein longitudinal movement of the conveyor assembly is linked to longitudinal movement of the carriage; and wherein the carriage is configured to move in a first longitudinal direction towards the wrapping station frame to decrease a travel distance of the wrapper from the shear point to the elevator and the distance between the upstream end of the conveyor assembly and the elevator; and wherein the carriage is configured to move in a second longitudinal direction away from the wrapping station frame to increase the travel distance of the wrapper from the shear point to the elevator and the distance between the upstream end of the conveyor assembly and the elevator.

12. The packaging machine of claim 11, wherein the carriage is configured to move in the first longitudinal direction to accommodate a first sized wrapper and the carriage is configured to move in the second longitudinal direction to accommodate a second sized wrapper that is larger than the first sized wrapper.

13. The packaging machine of claim 12, wherein a longitudinal position of the carriage and the conveyor assembly is set based on a size of the package.

14. The packaging machine of claim 1, wherein a rotational speed of the scoring blade can be selectively increased or decreased;

wherein increasing the rotational speed of the scoring blade decreases a space between successive break lines, thereby decreasing a longitudinal length of the wrapper; and wherein decreasing the rotational speed of the scoring blade increases the space between successive break lines, thereby increasing the longitudinal length of the wrapper.

15. The packaging machine of claim 1, wherein the first set of conveyors and the second set of conveyors each includes a lower conveyor belt and an upper conveyor belt configured to grip a lateral edge of the web.

16. The packaging machine of claim 1, wherein the carriage further comprises a feed roller positioned upstream from the conveyor assembly, wherein the feed roller is configured to draw the web of packaging material from a web roll and towards the upstream end of the conveyor assembly.

17. The packaging machine of claim 1, wherein the carriage comprises opposing lateral side panels which support the conveyor assembly therebetween; and wherein the lateral side panels are slidably supported by corresponding rails on opposing lateral sides of the upper end of the unwind station base.

* * * * *